United States Patent [19]

Schwarzmann

[11] 4,450,419

[45] May 22, 1984

[54] MONOLITHIC REFLECTION PHASE SHIFTER

[75] Inventor: Alfred Schwarzmann, Mt Laurel, N.J.

[73] Assignee: RCA Corporation, New York, N.Y.

[21] Appl. No.: 428,242

[22] Filed: Sep. 29, 1982

[51] Int. Cl.[3] ..... H01P 1/185

[52] U.S. Cl. ..... 333/164; 333/161; 333/246

[58] Field of Search ..... 333/156–157, 333/160–161, 164, 245–246, 248, 162–163, 103–104; 328/155; 307/320, 510, 511

[56] References Cited

U.S. PATENT DOCUMENTS

| | | | |
|---|---|---|---|
| 3,423,699 | 1/1969 | Hines | 333/164 |
| 3,748,499 | 7/1973 | Schaffner | 307/295 |
| 3,909,751 | 9/1975 | Tang et al. | 333/164 X |
| 3,996,536 | 12/1976 | Camisa et al. | 333/157 |
| 4,205,282 | 5/1980 | Gipprich | 333/161 |
| 4,331,942 | 5/1982 | Matsunaga et al. | 333/161 |

*Primary Examiner*—Marvin L. Nussbaum

*Attorney, Agent, or Firm*—Joseph S. Tripoli; Robert L. Troike; Christopher Lyle Maginniss

[57] ABSTRACT

A reflection phase shifter includes transmission-type fractional phase shifters and a reflection-type fractional phase shifter. The fractional phase shifters include PIN diodes and transforming sections for transmission line matching. Three fractional phase shifters provide 45-, 90-, and 180-degree delays. The individual fractional phase shifters are selectably "switched in" by the application of bias signals.

9 Claims, 5 Drawing Figures

MONOLITHIC REFLECTION PHASE SHIFTER

This invention relates generally to radio frequency phase shifters and, more particularly, to a reflection-type, multibit, diode phase shifter suitable for use in a reflect array antenna system and which can be entirely fabricated on a semiconductor substrate by semiconductor processing.

In recent years radar and communications antenna systems have relied increasingly on electronic steering, employing phased arrays for rapid beam movement, in contrast to the slow movement afforded by mechanically-steered, rotating antennas. Phased arrays rely for their beam directionality on varying the time delay from the source of a common signal to each radiating element of the array. Diode phase shift networks are frequently employed in conjunction with each element to provide this time delay and thereby control the radiated beam direction.

One drawback, however, of the phased array antenna system is the method of signal distribution to the several array elements. Whereas an antenna such as a parabolic reflecting antenna utilizes a single signal radiator situated at the focus of the parabola which reflects the signal along parallel rays, a phased array antenna must distribute the signal to each element via electrical conduction. This necessitates a complex and multi-tiered hierarchy of power dividers. In a typical distribution network employing binary power dividers such as hybrids, an antenna array comprising N by M elements requires at least NM−1 dividers. Such a distribution network adds size, weight and power losses to the antenna array.

More recently, an array antenna system has been developed which includes the electronic steering of the phased array while maintaining the single signal-radiating source of the parabolic reflecting antenna. This is the reflect array antenna which includes a radiating source positioned in front of a flat array of reflection elements. Each element receives the radiated signal and, after a predetermined delay, reflects the signal. The delay of each element is electronically tuned so that the reflected wavefront simulates the parallel rays which would be reflected by a parabolic antenna.

As is the case in phased array antennas, the delays in a reflect array antenna are frequently provided by diode phase shifters. However, where the phase array system utilizes transmission phase shifters, in which the phase shift is inserted between the input and output ports, a reflect array system requires reflection phase shifters, wherein the phase shift is provided as a reflection of the signal incident at the single port which functions both as input and output.

In order to function well within a large reflect array antenna system, a reflection phase shifter must provide a number of electrically selectable delays, or phase shifts. It must be well-matched among its several delay segments to minimize the amplitude of unintended reflections, and it must provide near total reflection in order to achieve the maximum signal output. Further, broadband operation (greater than 10%) is a desirable design goal.

In a reflect array system each element requires one phase shifter. In a large antenna system, this amounts to a very great number of identical phase shifters which must be able to handle large amounts of power. It is therefore an objective to provide such a phase shifter which can be produced inexpensively in large quantity. A monolithic semiconductor fabrication procedure is an advantageous method of meeting this objective.

In accordance with one embodiment of the present invention, a reflection phase shifter is disclosed which comprises a plurality of serially-connected fractional phase shifters, including at least one transmission-type phase shifter coupled to a reflection-type phase shifter. The transmission-type fractional phase shifter comprises serially-connected PIN diodes and a transforming section; the reflection-type fractional phase shifter comprises a transforming section coupled to a terminated PIN diode. The phase shifter also includes means coupled to the fractional phase shifters for applying bias signals to the fractional phase shifters.

Figure 1:
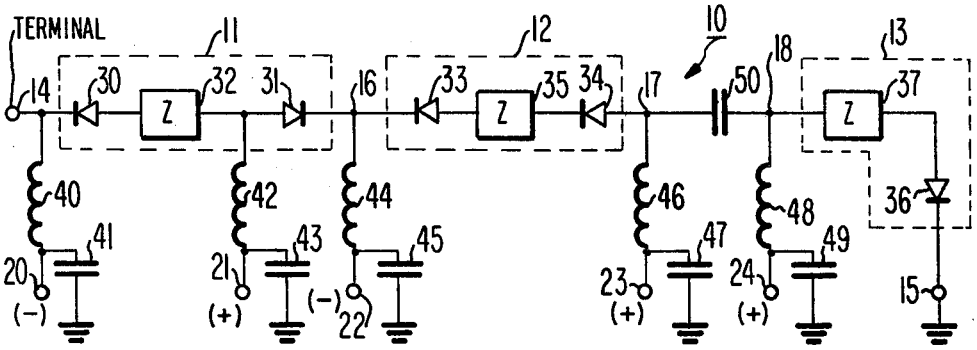
FIG. 1 is a circuit diagram of one embodiment of the present invention.

Referring to FIG. 1, a reflection phase shifter 10 is shown in circuit diagram representation. Phase shifter 10 comprises 22.5-degree transmission-type phase shifter 11, 45-degree transmission-type phase shifter 12, and 180-degree reflection-type phase shifter 13. Fractional phase shifters 11, 12 and 13 are connected in cascade between terminal 14 and reflection terminal 15. Terminal 14 serves as both an input terminal for receiving an input signal and as an output terminal at which the phase-shifted input signal appears.

Each of the transmission-type fractional phase shifters 11 and 12 includes two selectable capacitances and a transforming section. The selectable capacitances are devices which can be switched between two substantially constant values of capacitance by the appropriate application of a bias current therethrough. In the embodiments described for the present invention, these devices are shown as PIN diodes. The transforming sections transform the PIN diode impedance reciprocally such as to effect a good bidirectional impedance match. Transmission-type fractional phase shifters 11 and 12 are coupled to means for selectively providing bias current through the PIN diodes.

Fractional phase shifter 11, coupled between terminal 14 and node 16, comprises PIN diodes 30 and 31 and transforming section 32 coupled therebetween. A first bias circuit, comprising RF choke 40, bypass capacitor 41, and voltage supply terminal 20, is coupled to fractional phase shifter 11 at the node where the cathode of PIN diode 30 is electrically connected to terminal 14. A second bias circuit, comprising RF choke 42, bypass capacitor 43, and voltage supply terminal 21, is connected to fractional phase shifter 11 at the node where the anode of PIN diode 31 is electrically connected to one end of transforming section 32. A third bias circuit, comprising RF choke 44, bypass capacitor 45, and voltage supply terminal 22, is coupled at node 16 which electrically interconnects fractional phase shifters 11 and 12.

The polarities of PIN diodes 30 and 31 are arranged such that for a first configuration of the supply voltages applied to terminals 20, 21 and 22, namely, the voltage at terminal 21 being more positive than the voltages at terminals 20 and 22, bias current flows through PIN diodes 30 and 31. For a second configuration of the supply voltages applied to terminals 20, 21 and 22, namely, the voltage at terminal 21 being equal to or more negative than the voltages at terminals 20 and 22, no bias current flows through PIN diodes 30 and 31.

Thus, as the voltage applied at terminal 21 varies with respect to the voltages applied at terminals 20 and 22, bias currents are switched through PIN diodes 30 and 31, and the capacitance of fractional phase shifter 11 is switched between two substantially constant values. Through proper selection of the impedances of PIN diodes 30 and 31 and of transforming section 32, the two substantially constant values of capacitance can be made to provide a differential phase shift of 22.5 degrees to an RF signal of selected frequency applied at terminal 14.

Fractional phase shifter 12, coupled between fractional phase shifters 11 and 13, comprises PIN diodes 33 and 34 and transforming section 35 coupled therebetween. A fourth bias circuit, comprising RF choke 46, bypass capacitor 47, and voltage supply terminal 23, is coupled to fractional phase shifter 12 at node 17.

The polarities of PIN diodes 33 and 34 are arranged such that for a first configuration of the supply voltages applied at terminals 22 and 23, namely, the voltage at terminal 23 being more positive than the voltage at terminal 22, bias current flows through PIN diodes 32 and 33. For a second configuration of the supply voltages applied at terminals 22 and 23, namely, the voltage at terminal 23 being equal to or more negative than the voltage at terminal 22, no bias current flows through PIN diodes 32 and 33.

Thus, as the voltage applied at terminal 23 varies with respect to the voltage applied at terminal 22, bias current is switched through PIN diodes 33 and 34, and the capacitance of fractional phase shifter 12 is switched between two substantially constant values. Through proper selection of the impedances of PIN diodes 33 and 34 and of transforming section 35, the two substantially constant values of capacitance can be made to provide a differential phase shift of 45 degrees to an RF signal of selected frequency applied at node 16, the input of fractional phase shifter 12.

The reflection-type fractional phase shifter 13 comprises PIN diode 36 in series with transforming section 37. A fifth bias circuit, comprising RF choke 48, bypass capacitor 49, and voltage supply terminal 24, is connected to fractional phase shifter 13 at node 18 such that when a voltage is applied to terminal 24, which voltage is more positive than the voltage applied at terminal 15, bias current flows through PIN diode 36. No bias current flows through PIN diode 36 when the voltage at terminal 24 is equal to or more negative than the voltage at terminal 15. In the first and second embodiments disclosed herein, terminal 15 is shown as coupled to reference ground.

Thus, as the voltage applied at terminal 24 varies with respect to the voltage at terminal 15, bias current is switched through PIN diode 36, and the capacitance of fractional phase shifter 13 is switched between two substantially constant values. Through proper selection of the impedances of PIN diode 36 and transforming section 37, the two substantially constant values of capacitance can be made to provide a differential phase shift of 180 degrees to an RF signal of selected frequency applied at node 18, the input of fractional phase shifter 13.

Fractional phase shifters 12 and 13 are coupled by dc blocking capacitor 50 which serves to isolate the bias currents provided by the fourth and fifth bias circuits. Capacitor 50 is chosen sufficiently large so that it presents a low impedance to RF signals in the desired frequency band of operation.

Phase shifter 10 operates at radio frequencies; hence its adjacent fractional phase shifters must be well-matched in order to avoid unwanted reflections. Furthermore, where signal reflection is required, it must be a substantially complete reflection. An RF signal incident on terminal 14 passes through fractional phase shifters 11, 12 and 13. After passing through the final fractional phase shifter 13, it encounters terminal 15, which may be shorted to ground, causing substantially complete reflection back through fractional phase shifters 13, 12 and 11, until the signal returns to terminal 14.

For the situation where all bias currents are off, i.e., a single voltage is applied to all terminals 20 through 24 and 15, the reflected signal exiting at terminal 14 has a fixed phase relationship with the corresponding signal which entered terminal 14. When fractional phase shifter 11 is "switched in," i.e., the voltage at terminal 21 is positive with respect to the voltage at terminals 20 and 22, an RF signal entering at terminal 14 encounters an additional 22.5 degree delay upon passing through the fractional phase shifter 11 for first time and a second additional 22.5 degree delay upon exiting. Fractional phase shifter 11 thus provides a selectable 45 degree differential delay to signals applied at terminal 14.

Similarly, when fractional phase shifter 12 is "switched in," i.e., the voltage at terminal 23 is positive with respect to the voltage at terminal 22, an RF signal entering fractional phase shifter 12 at node 16 encounters an additional 45 degree delay between nodes 16 and 17 upon passing through the first time and a second additional 45 degree delay between nodes 17 and 16 upon its return after reflection, thus providing a selectable 90 degree differential delay to signals applied to phase shifter 10.

Finally, when fractional phase shifter 13 is "switched in," i.e., the voltage at terminal 24 is positive with respect to the voltage at terminal 15, an RF signal entering fractional phase shifter 13 at node 18 encounters an additional 90 degree delay between nodes 18 and 15 upon passing through the first time and a second additional 90 degree delay between nodes 15 and 18 upon its return after reflection, thus providing a selectable 180 degree differential delay to signals applied to phase shifter 10.

The net effect of the contributions of the selectable delays of fractional phase shifters 11, 12 and 13 is a phase shifter 10 which provides selectable differential delays to an RF signal of predetermined frequency at all multiples of 45 degrees. Selection of the delay is accomplished by application of a positive voltage to the appropriate terminals from among terminals 21, 23 and 24 to control, respectively, the 45-, 90-, and 180-degree phase shifts.

Figure 2:
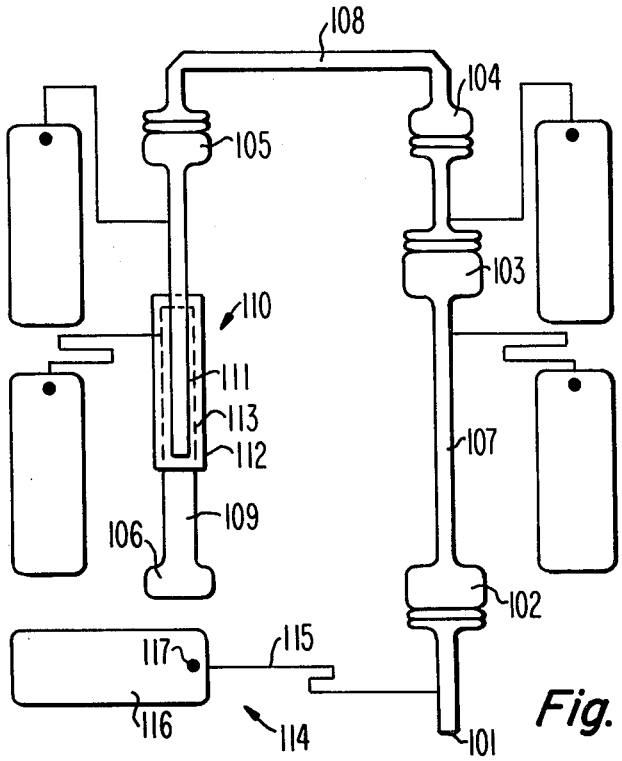
FIG. 2 is a plan view of a monolithic layout of the embodiment of FIG. 1.

FIG. 2 depicts, in plan view, a layout of phase shifter 10 of FIG. 1, as it might be fabricated in monolithic form. Not only does the monolithic approach provide an economic means for manufacturing the circuit in large scale, but it also results in a circuit which virtually eliminates the stray impedances associated with PIN diode wiring and terminals, and provides a stripline medium for accurate fabrication of transmission lines and transforming sections, even at high microwave frequencies.

Signals are applied at terminal 101 (corresponding to terminal 14 of FIG. 1) and pass, respectively, through PIN diodes 102, 103, 104, 105 (corresponding, respectively, to PIN diodes 30, 31, 33, and 34 of FIG. 1) and finally through PIN diode 106, (corresponding to PIN diode 36 of FIG. 1), where they are reflected back to terminal 101. The ground plane (not shown) is etched away in the vicinity of PIN diodes 102 through 105 to prevent capacitive coupling between the diodes and ground which would create unwanted reflections. Electrically conductive strips 107, 108 and 109, in conjunction with the ground plane (not shown), correspond, respectively, to transforming sections 32, 35, and 37 of FIG. 1. Blocking capacitor 110 of FIG. 2 (corresponding to blocking capacitor 50 of FIG. 1) comprises electrical conductors 111 and 112 separated by insulating layer 113.

The five bias circuits of FIG. 1 are shown in FIG. 2 and are typified by circuit 114. Circuit 114 comprises narrow conductive lead 115 and quarter-wavelength conductive section 116. Lead 115 is a quarter-wavelength long at the center frequency of operation and its narrowness presents an extremely high impedance to RF signals; hence it is effective as an RF choke. Quarter-wavelength conductive section 116 acts as a capacitor, bypassing stray RF signals to ground. Bias voltage is applied at connection terminal 117 on section 116, adjacent to narrow conductive lead 115.

The phase shifter 10, shown in circuit diagram in FIG. 1 and in monolithic layout in FIG. 2, is designed for use in a 50-ohm transmission line system, operates at X-band (5.2 to 10.9 GHz), and is capable of handling peak pulsed signals in excess of 100 watts. Typical parameters of this type of phase shifter are as follows:

| | |
|---|---|
| Junction capacitance | |
| PIN diodes 30 and 31 | 0.6 pf |
| PIN diodes 33, 34 and 36 | 0.3 pf |
| Characteristic impedance | |
| Transforming section 32 | 52 ohms |
| Transforming section 35 | 55 ohms |
| Transforming section 37 | 25 ohms |
| Electrical length (relative to the centerband wavelength) | |
| Transforming section 32 | 95 degrees |
| Transforming section 35 | 98 degrees |
| Transforming section 37 | 85 degrees |

Figure 3:
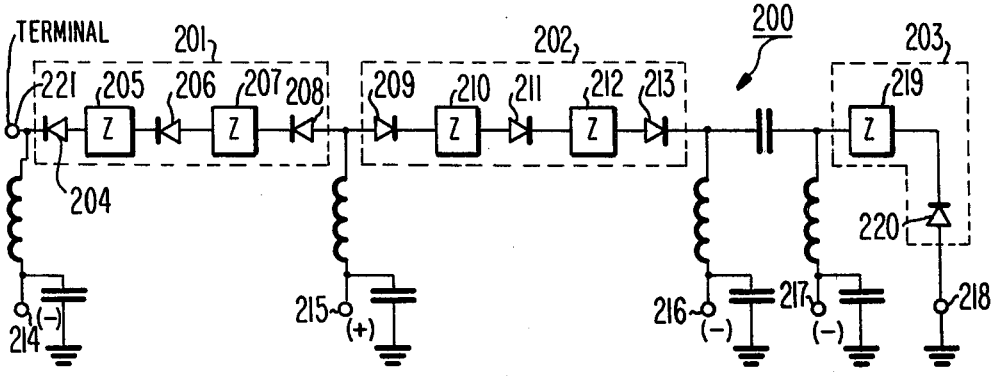
FIG. 3 is a circuit diagram of a second embodiment of the present invention.

Referring to FIG. 3, a second embodiment of the present invention is shown in circuit diagram representation. Phase shifter 200 comprises two transmission-type fractional phase shifters 201 and 202, providing, respectively, 45-degree and 90-degree phase shifts, and reflection-type fractional phase shifter 203, providing a phase shift of 180 degrees. These fractional phase shifters, when arranged as shown in FIG. 3, each provide two delays to an incident RF signal—once as the input signal travels from terminal 221 toward reflection terminal 218 and again as the reflected signal travels back toward terminal 221. There are two major differences between phase shifter 200 and phase shifter 10 (of FIG. 1): (1) the transmission-type fractional phase shifters 201 and 202 have been arranged to provide a device having a greatly increased bandwidth; and (2) the diode polarities and bias voltage polarities have been arranged such that one fewer bias circuit is required.

By employing three PIN diodes having junction capacitance values enumerated below, fractional phase shifters 201 and 202 appear as bandpass filters having a substantially flat response over a more than 10 percent bandwidth near the top end of the X-band. Bandpass filter theory would suggest that the outer PIN diodes of the three have equal capacitance which would be twice the capacitance of the central PIN diode. Further, the transforming sections within each fractional phase shifter should be identical.

Phase shifter 200 employs a different method from that of phase shifter 10 for bias current switching. Fractional phase shifter 201 is "switched in" when the voltage applied at terminal 214 becomes more negative than the voltage at terminal 215, which may be ground. Fractional phase shifter 202 is "switched in" when the voltage applied at terminal 216 becomes more negative than the voltage at terminal 215. Fractional phase shifter 203 is "switched in" when the voltage applied at terminal 217 becomes more negative than the voltage at reflection terminal 218. In this embodiment, reflection terminal 218 is coupled to ground. Hence, phase shifter 200 is a broadband device which provides selectable differential delays at all multiples of 45 degrees to an RF signal by the suitable application of negative voltage to the appropriate terminals from among terminals 214, 216, 217 to control, respectively, the 45-, 90- and 180-degree phase shifts.

Figure 4:
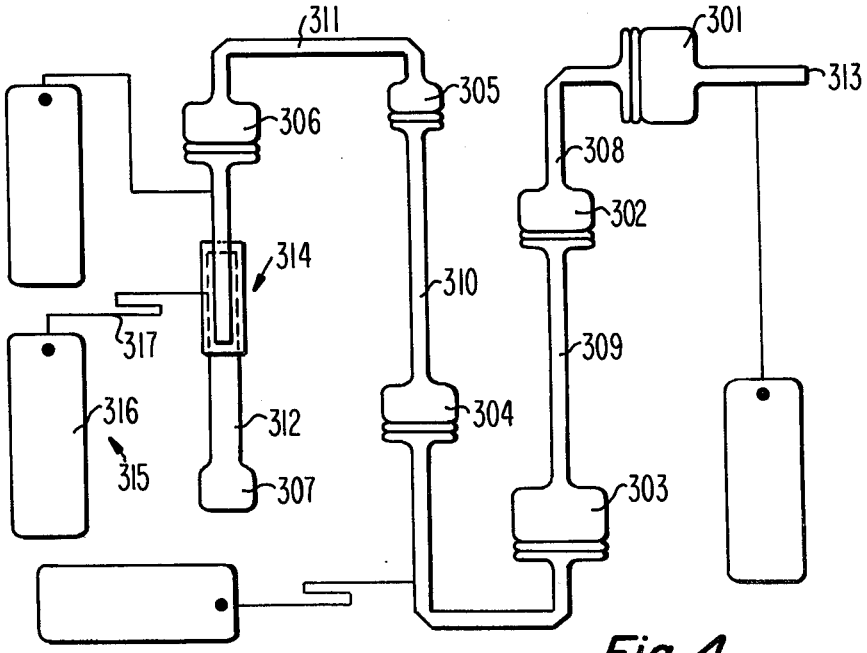
FIG. 4 is a plan view of a monolithic layout of the embodiment of FIG. 4.

FIG. 4 depicts, in plan view, a layout of phase shifter 200 of FIG. 3, as it might be fabricated in monolithic form. PIN diodes 301, 302, 303, 304, 305, 306 and 307 of FIG. 4 correspond, respectively, to PIN diodes 204, 206, 208, 209, 211, 213 and 220 of FIG. 3. Transforming sections 308, 309, 310, 311 and 312 of FIG. 4 correspond, respectively, to transforming sections 205, 207, 210, 212 and 219 of FIG. 3. The monolithic layout also includes blocking capacitor 314 and input terminal 313 coupled to PIN diode 301. FIG. 3 further includes four bias circuits typified by circuit 315 comprising quarter-wavelength section 316, functioning as a bypass capacitor, and narrow conductive lead 317, functioning as an RF choke.

The phase shifter 200, shown in FIG. 3 and in FIG. 4, is, like the embodiment of FIGS. 1 and 2, designed for use in a 50-ohm system involving high power-handing X-band applications. Typical parameters for this type of phase shifter are as follows:

| | |
|---|---|
| Junction capacitance | |
| PIN diodes 204 and 208 | 1.2 pf |
| PIN diodes 206, 209 and 213 | 0.6 pf |
| PIN diodes 211 and 220 | 0.3 pf |
| Characteristic impedance | |
| Transforming sections 205 and 207 | 51 ohms |
| Transforming sections 210 and 212 | 52 ohms |
| Transforming section 219 | 25 ohms |
| Electrical length (relative to the centerband wavelength) | |
| Transforming sections 205 and 207 | 83 degrees |
| Transforming sections 210 and 212 | 82 degrees |
| Transforming section 219 | 85 degrees |

Figure 5:
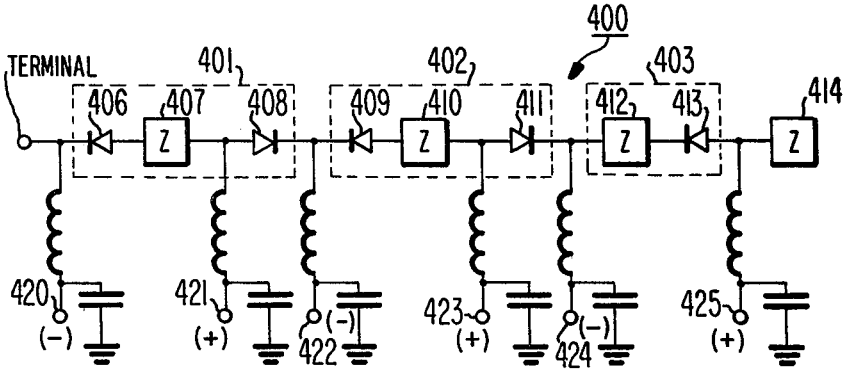
FIG. 5 is a circuit diagram of a third embodiment of the present invention.

The third embodiment, as shown in circuit diagram representation in FIG. 5, is a variation of phase shifter 10 of FIG. 1, but with the elements associated with the reflection-type fractional phase shifter altered so that the blocking capacitor may be eliminated. Although transmission-type fractional phase shifter 402 is also altered, in addition to reflection-type fractional phase shifter 403, the only major change required to eliminate the blocking capacitor involves the method of terminating PIN diode 413 within the reflection-type phase shifter 403. In this embodiment the reflection is caused by the open circuit termination at section 414.

In the embodiment of FIG. 5, the 22.5-degree fractional phase shifter 401 is "switched in" by the application of a voltage at terminal 421 which is more positive than the voltages at terminals 420 and 422. The 45-degree fractional phase shifter 402 is "switched in" by the application of a voltage at terminal 423 which is more positive than the voltages at terminals 422 and 424. The 180-degree reflection-type fractional phase shifter 403 is "switched in" by the application of a voltage at terminal 425 which is more positive than the voltage at terminal 424.

Thus, three embodiments of a reflection phase shifter, each comprising transmission-type fractional phase shifters and a reflection-type fractional phase shifter, and each suitable for fabrication using a monolithic technique, have been disclosed.

What is claimed is:

1. A reflection phase shifter comprising:

a plurality of serially-connected fractional phase shifters including at least one transmission-type phase shifter coupled to a reflection-type phase shifter, wherein said at least one transmission-type fractional phase shifter comprises serially-connected PIN diodes and a transforming section and said reflection-type fractional phase shifter comprises a transforming section coupled to a terminated PIN diode; and means coupled to said fractional phase shifters for applying bias signals to said fractional phase shifters.

2. The phase shifter according to claim 1 including two transmission-type fractional phase shifters.

3. The phase shifter according to claim 2 wherein said three fractional phase shifters provide selectable differential delays, respectively, of 45 degrees, 90 degrees, and 180 degrees, to an operating signal at a predetermined frequency in a desired band of frequencies.

4. The phase shifter according to claim 1 further including terminal means coupled to one of said transmission-type fractional phase shifters adapted for receiving an RF signal.

5. The phase shifter according to claim 1 further including a capacitor coupled between an adjacent pair of said fractional phase shifters to dc isolate said adjacent pair of fractional phase shifters.

6. The phase shifter according to claim 1 wherein each of said transmission-type fractional phase shifters includes three PIN diodes serially connected and separated by two transforming sections, and wherein the outer two of said serially-connected PIN diodes have junction capacitances which are substantially equal and which are substantially twice the junction capacitance of the central one of said serially-connected PIN diodes.

7. The phase shifter according to claim 6 wherein said two transforming sections are substantially identical.

8. The phase shifter according to claim 1 wherein said means for applying bias signals to each of said fractional phase shifters comprises the combination of at least one RF choke and means for coupling said at least one RF choke to a bias source.

9. The phase shifter according to claim 8 further including a bypass capacitor coupled between said coupling means and a point of reference potential.

* * * * *